US008882286B1

(12) United States Patent
Delgado Antunez

(10) Patent No.: US 8,882,286 B1
(45) Date of Patent: Nov. 11, 2014

(54) RELATIONSHIP STATUS BRACELET

(71) Applicant: Jose Juan Delgado Antunez, Las Vegas, NV (US)

(72) Inventor: Jose Juan Delgado Antunez, Las Vegas, NV (US)

( * ) Notice: Subject to any disclaimer, the term of this patent is extended or adjusted under 35 U.S.C. 154(b) by 0 days.

(21) Appl. No.: 13/706,751

(22) Filed: Dec. 6, 2012

Related U.S. Application Data

(60) Provisional application No. 61/570,036, filed on Dec. 13, 2011.

(51) Int. Cl.
*F21V 21/08* (2006.01)
*F21V 33/00* (2006.01)

(52) U.S. Cl.
CPC ..... *F21V 33/0008* (2013.01)
USPC ..... 362/104; 362/249.02; 362/103

(58) Field of Classification Search
None
See application file for complete search history.

(56) References Cited

U.S. PATENT DOCUMENTS 3,823,550 A * 7/1974 Bergey ..... 368/69
8,015,088 B2 * 9/2011 Phillips et al. ..... 705/35
2001/0045033 A1 11/2001 Fischer
2007/0041193 A1 * 2/2007 Wong et al. ..... 362/276
2007/0250333 A1 10/2007 DeLuca
2008/0053146 A1 3/2008 Burress
2009/0251888 A1 * 10/2009 Douglas ..... 362/103
2010/0085279 A1 * 4/2010 Repko ..... 345/76
2010/0091517 A1 * 4/2010 Brockman et al. ..... 362/555
2011/0194276 A1 * 8/2011 Au ..... 362/104

* cited by examiner

*Primary Examiner* — Donald Raleigh
(74) *Attorney, Agent, or Firm* — Gold & Rizvi, P.A.; Glenn E. Gold

(57) ABSTRACT

A relationship status bracelet includes a housing, a circumferential band, and a relationship indicating electronic circuit. The housing provides an enclosure having a circumferential sidewall, a top surface, and an opposing bottom surface. The relationship indicating electronic circuit includes a microprocessor comprising programming to operate in accordance with the desired functionality, a portable power source, at least one light emitting device enabling illumination of the device in a sequence of at least two colors to convey a meaning to others. The user can advance through the sequence of established colors by cycling engagement between a magnet and a magnetic switch. The magnetic switch toggles an electrical circuit signaling the electronic circuit assembly to advance through the sequence of established colors until a desired color is activated. The last step of the sequence would terminate operation of the relationship status bracelet.

19 Claims, 3 Drawing Sheets

RELATIONSHIP STATUS BRACELET

CROSS-REFERENCE TO RELATED APPLICATION

This Non-Provisional Utility application claims the benefit of U.S. Provisional Patent Application Ser. No. 61/570,036, filed on Dec. 13, 2011, which is incorporated herein in its entirety.

FIELD OF THE INVENTION

The present invention relates generally to jewelry or wearable articles. More particularly, the present invention relates to a bracelet that is user selectable to signal by colored light waves the relationship status or other personal characteristic to other persons in a social setting.

BACKGROUND OF THE INVENTION

Historically, it has been common practice for married or engaged men and women to wear a ring to indicate their relationship status. However, this time-honored tradition does not adequately provide for many situations that may be encountered in today's social settings. Although the wearing of a ring on the ring finger of the left hand gives a clear indication that a person is either engaged or married, many single individuals who are dating are left in a conundrum as they are not yet engaged or married, but are in a serious and committed relationship and therefore are not interested in looking for other people to date. Many individuals, both male and female, would enjoy or desire to meet other individuals for various social purposes such as dating. In many cases, most of these individuals would also prefer to meet others with like interests or with specific qualities. Unfortunately today, an individual cannot immediately tell much about another individual when they initially meet except for whether that person is wearing a wedding/engagement ring. As a result, this creates a situation where an individual may approach or spend a considerable amount of time with someone before they find out whether or not they are compatible or even available to date.

In addition, persons who are divorced or widowed oftentimes find themselves in quandary as well as perhaps the person is not yet ready to start dating again, no longer wishes to wear a wedding ring, and yet is constantly approached by other people looking to date them. Moreover, many same-sex oriented individuals also find themselves in a difficult situation wherein a dater, who is interested in a same-sex relationship, makes advances or receives advances from someone of the opposite sex.

Correspondingly, it is desirable to be able to visually indicate to others some important qualities about the individual and what type of companion is being sought, if any. However, to date, there has been no convenient and discrete way of signaling to another person what an individual's interests and characteristics may be other than the well-known use of a wedding/engagement ring. As a result, individuals may spend substantial amounts of time in social interaction with others before they realize that the other individual is incompatible with them.

Efforts to provide a piece of jewelry or wearable article that discretely, conveniently and quickly indicates, to other people in a social setting, the relationship status and various interests of the wearer, have not met with significant success to date. As a result, there is a need in the art for a piece of jewelry or wearable article that a user may configure to communicate specific characteristics of the wearer to other people in a social setting.

SUMMARY OF THE INVENTION

The basic inventive concept provides a relationship status bracelet, wherein the bracelet includes a light emitting configuration comprising at least one light emitting element, the at least one light emitting element configured to emit at least two different colored lights based upon the wearer's selection.

A first aspect of the present invention provides a relationship status bracelet comprising:

a housing having a sidewall, a top surface, and an opposing bottom surface collectively defining a housing enclosure;

a circumferential band extending from a first region of the housing to a second region of the housing, the second region being located circumferentially opposite the first region of the housing; and an electronic circuit assembly disposed within the housing enclosure, the electronic circuit assembly in signal communication with a status mode switch and a light emitting configuration having functionality for emitting at least two colors, wherein, in operation, a user configures the electronic circuit assembly to emit a specific color light wave from the a light emitting configuration by cycling the status mode switch.

In a second aspect of the present invention, the status mode switch is a magnetically operated switch, wherein, in operation, a user configures the electronic circuit assembly to emit a specific color light wave from the a light emitting configuration by cycling engagement between a magnet and the magnetically operated switch.

In another aspect, the relationship bracelet further comprises a fiber optic strand circumscribing the circumferential band, the fiber optic strand having at least one fiber optic end.

In yet another aspect, the light emitting configuration assembled in lighted communication with the at least one fiber optic end.

In yet another aspect, the at least two colors of the light emitting configuration includes a first colored light and a second colored light, and the electronic circuit assembly configured to cycle between illuminating the first colored light, the second colored light, and no light, each change in state of illumination generated by cycling engagement between a magnet and the magnetically operated switch.

In yet another aspect, the light emitting configuration further comprises a first colored light and a second colored light, and the electronic circuit assembly configured to cycle between a steady illumination of the first colored light, a steady illumination of the second colored light, and no light, each change in state of illumination generated by cycling engagement between a magnet and the magnetically operated switch.

In yet another aspect, the light emitting configuration further comprises a first colored light and a second colored light, and the electronic circuit assembly configured to cycle between illumination of the first colored light, illumination of the second colored light, and no light, each change in state of illumination generated by cycling engagement between a magnet and the magnetically operated switch, wherein at least the illumination of at least one of the first colored light and the second colored light is flashing.

In yet another aspect, the top surface of the housing is a translucent top cover; the translucent top cover is fabricated of a material enabling passage of light therethrough.

In yet another aspect, the relationship bracelet further comprises a solar cell, wherein the solar cell provides power to the electronic circuit assembly.

In yet another aspect, the relationship bracelet further comprises a portable power storage device, wherein the portable power storage device provides power to the electronic circuit assembly.

In use, the relationship bracelet is integrated into a method comprising steps of:

placing a relationship bracelet onto a wrist of an individual, the relationship bracelet comprising:

a housing having a circumferential sidewall, a top surface, and an opposing bottom surface collectively defining an enclosure;

a circumferential band extending from a first region of the housing to a second, circumferentially opposite region of the housing; and an electronic circuit assembly disposed within the housing, the electronic circuit assembly in signal communication with a status switch and a light emitting configuration having functionality for emitting at least two colors, wherein, in operation, a user configures the electronic circuit assembly to emit a specific color light wave from the light emitting configuration by cycling the status switch;

cycling engagement of the status switch until the electronic circuit assembly emits a desired illumination, wherein a first colored emitted light wave indicates that the individual wearing the relationship bracelet is available and a second colored emitted light wave indicates that the individual wearing the relationship bracelet is currently in a relationship.

In yet another aspect, the method further comprising steps accomplished by a second individual, the steps comprising:

viewing the currently emitted light wave; and determining the relationship status of the individual wearing the relationship bracelet by relating the color of the currently emitted light wave.

In yet another aspect, the method further comprises a step of cycling engagement between a magnet and the magnetically operated switch until the electronic circuit assembly emits the desired illumination.

In yet another aspect, the method further comprising a step of emitting light waves from circumferential band by transferring light from the light emitting configuration to the illuminating the fiber optic strand.

In yet another aspect, the method further comprising a step of:

cycling through the light emitting configuration, wherein the light emitting configuration comprises a series of unique colors, wherein the light emitting configuration comprise one unique color representing at least one of:

a) available for a relationship,
b) seeking a casual relationship,
c) seeking a long term relationship,
d) unavailable for a relationship,
e) has religious beliefs,
f) has radical tendencies,
g) has a liberal philosophy,
h) has a conservative philosophy,
i) has traditional values, and
j) does not take drugs.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

In the figures, like reference numerals designate corresponding elements throughout the different views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments, which may be disclosed herein are not to be considered as limiting, unless the claims expressly state otherwise.

Figure 1:
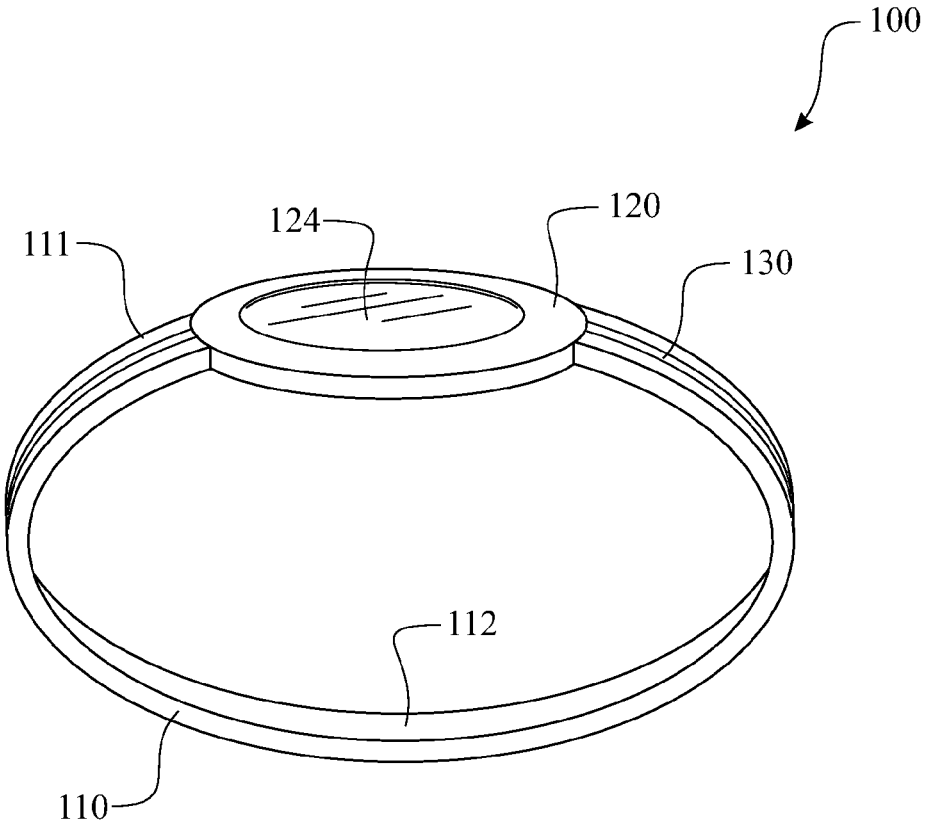
FIG. 1 presents an isometric view of a relationship status bracelet in accordance with one exemplary embodiment of the present invention.
Figure 2:
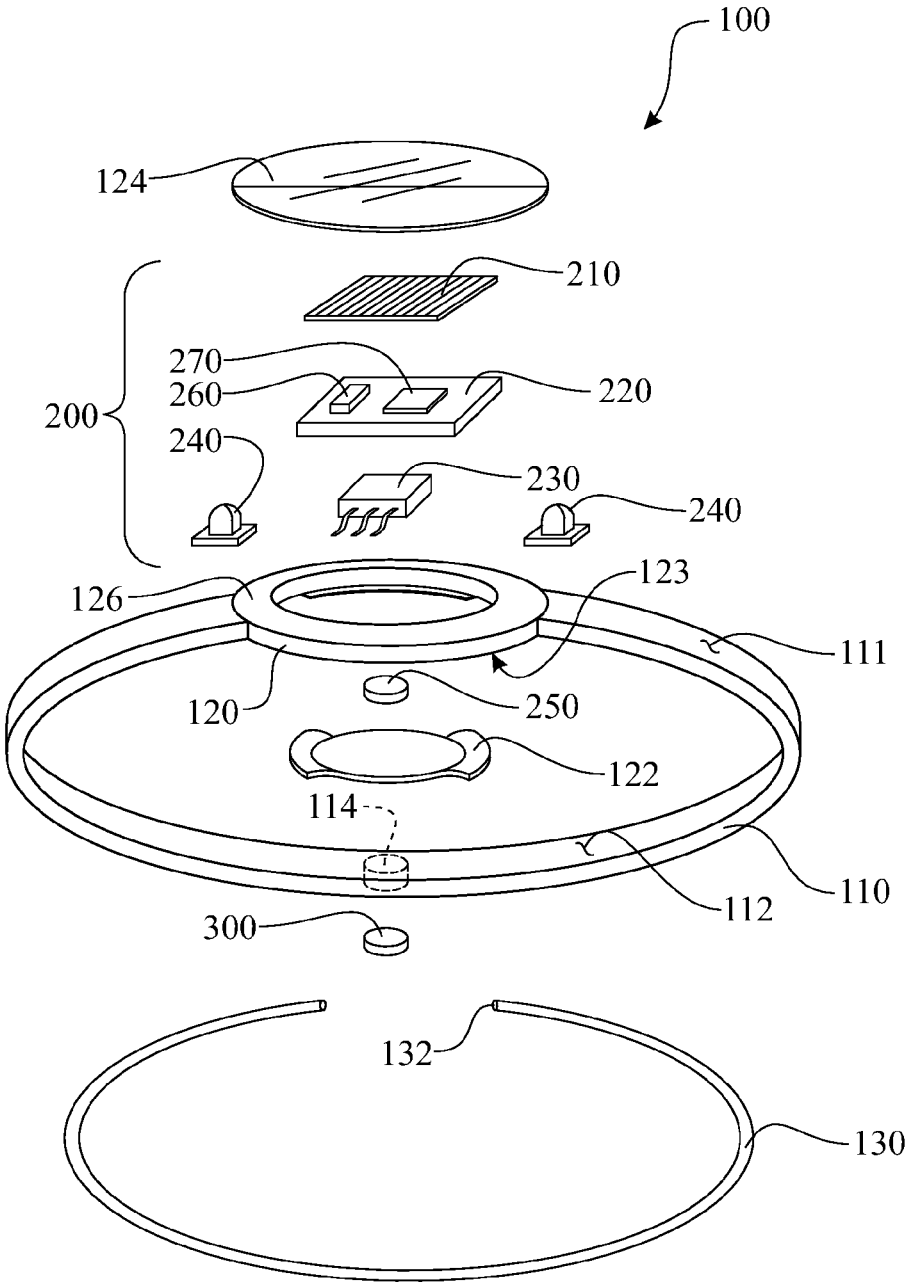
FIG. 2 presents an exploded view of FIG. 1 in accordance with one exemplary embodiment of the present invention.

An exemplary user configurable relationship status bracelet 100 is illustrated in FIGS. 1 and 2. The relationship status bracelet 100 is preferably configured for wearable deployment by a user. The relationship status bracelet 100 includes a circumferential band 110 that may be elastomeric such that circumferential band 110 may stretch around a hand of the user. Alternatively, circumferential band 110 may be non-stretchable and include a clasp (not shown) for opening and closing such that the circumferential band 110 may be placed around the wrist of a user. The circumferential band 110 has an outwardly facing surface 111 and an opposing inwardly facing surface 112. The relationship status bracelet 100 further includes an electronics housing 120 that encases various electrical components, which are described in greater detail below and referenced within an exploded assembly view presented in FIG. 2. Preferably, the electronics housing 120 is configured as a water-resistant or waterproof enclosure that protects the electrical components from damage from exposure to external contaminants, such as moisture, dust, and the like. In the exemplary embodiment, the circumferential band 110 of relationship status bracelet 100 includes a fiber optic strand 130 that is embedded into the outwardly facing surface 111. The relationship status bracelet 100 may be fabricated from various materials such as silicon, plastic, metal, leather, rubber, fabric, or any other suitable material. The fabrication of the various elements and features of the relationship status bracelet 100 may be performed by one or more well-known manufacturing processes that one of ordinary skill in the art would readily understand. These materials and processes are not described in detail so as not to obscure the teachings of the present invention. Although the exemplary relationship status bracelet 100 is illustrated having an oval shaped electronics housing 120, it is understood that the relationship status bracelet 100 may be fabricated in any of many various shapes, textures, colors, or combinations thereof as fashionably and functionally desired.

Various operational components of the relationship status bracelet 100 are detailed in an exploded view presented in FIG. 2. An electronics circuit assembly 200 is encased within the electronics housing 120. In the exemplary embodiment, the electronic circuit assembly 200 includes a photovoltaic solar cell 210, a printed circuit board (PCB) 220, a magnetic relay 230 and at least one light emitting diode (LED) 240. A battery 250 is retained within the cavity by the bottom cover 122 that couples to a bottom surface 123 of the electronics housing 120. The battery 250 is contemplated to be a rechargeable component such as a lithium-ion battery, however, other types of portable power storage devices may be employed such as a super capacitor, a nickel-cadmium battery (NiCad), nickel-metal hydride battery (NiMh), and the like. The bottom cover 122 may be either removably coupled to bottom surface 123 or permanently coupled therewith to provide a sealed cavity within the electronics housing 120 such that the electronic circuit assembly 200 and battery 250 are adequately protected over a lifespan of the relationship status bracelet 100. It is contemplated that electronics housing 120 has a translucent or transparent top cover 124 coupled to a top surface 126 thereof. The top cover 124 is preferably configured to retain the electronic circuit assembly 200 within the electronics housing 120 and further permit light waves to pass therethrough and operatively engage with the solar cell 210.

Figure 3:
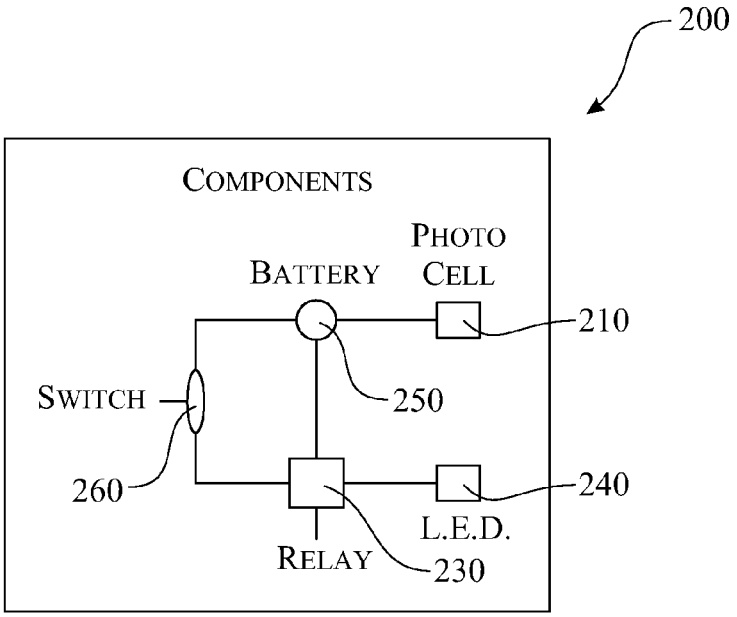
FIG. 3 presents a block diagram schematic of an electronic circuit in accordance with one exemplary embodiment of the present invention.

In combination of FIGS. 2 and 3, the solar cell 210 absorbs light from sunlight or other suitable light sources and converts the power to an electrical power output that charges the battery 250 when exposed to. The solar cell 210 (also commonly referred to as a photovoltaic cell or a photoelectric cell) is generally a solid-state electrical device that converts light energy directly into electrical power by a photovoltaic effect, which is well known to those of ordinary skill in the art. The solar cell 210 is provided in electrical communication with the PCB 220 by an electrical conduit, such as wires, a flexible circuit, and the like, to provide electronic functionality of electronic circuit assembly 200. Alternated charging configurations may be employed to transfer electrical power to the relationship status bracelet 100. The alternative charging configurations such as direct charging, inductive charging, and the like, or combinations thereof, may be made available for recharging the battery 250.

The PCB 220 is contemplated to provide for electric conveyance between the various electronic components described herein and may further include a magnetic switch 260 and one or more microprocessors 270 operatively coupled therewith. In other alternative embodiments, the PCB 220 may include other electrical components such as resistors, capacitors, timers, voltage regulators, proximity sensors, and the like, to provide various electronic functionality and respective controller circuitry therein. Further, the PCB 220 includes a magnetic relay 230 used to electrically change the relationship status bracelet 100 between various light emitting modes as desired by the user. In one exemplary embodiment, one or more light emitting diode 240 are electrically coupled to PCB 220 and positioned such that light waves may emit outwardly from the electronics housing 120 such that the light waves are externally visible. It is contemplated that the light emitting diode 240 be a multi-color emitting device that is capable of being ohmically switched between different colors such as red, green and blue.

In one exemplary embodiment, a fiber optic strand 130 is embedded into the relationship status bracelet 100 such that light waves emitted by the light emitting diode 240 are visually transmitted though the fiber optic strand 130 to thereby provide enhanced visibility of the relationship status bracelet 100. The fiber optic strand 130 is in lighted communication with light emitting diode 240 by proximately locating fiber optic end 132 with respect to light emitting diode 240. Alternatively, enhanced visibility may be achieved by positioning a plurality (not shown) of light emitting diodes 240 spatially arranged around the outwardly facing surface 111 of circumferential band 110.

Further, the relationship status bracelet 100 includes a magnet 300, which is embedded into a recess 114 formed into the circumferential band 110 and preferably located opposite of the electronics housing 120. In this exemplary embodiment, the magnet 300 functions to operatively engage with the magnetic switch 260 when the magnet 300 is placed in close proximity thereof. The circumferential band 110 may be configured such that the magnet 300 may be moveably positioned proximate to the magnetic switch 260 such as by elastic deformation of the circumferential band 110. The magnet 300 may be one of many known magnetic materials such as neo-diamine earth. In an alternate embodiment, the magnet 300 may be disassociated with the circumferential band 110 and carried separately by the user of the relationship status bracelet 100.

Figure 4:
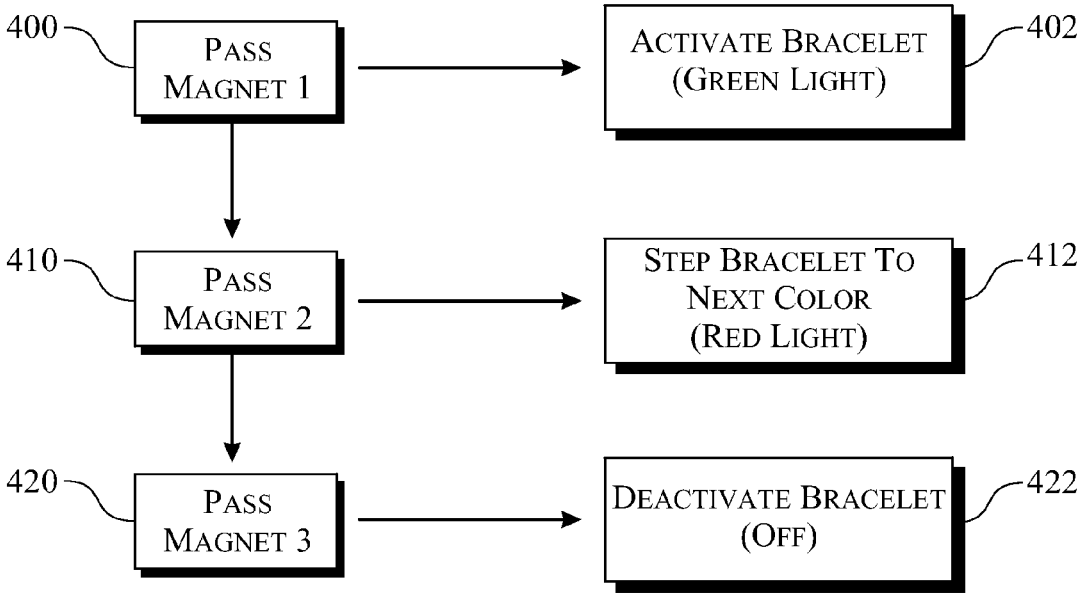
FIG. 4 presents a flow diagram illustrating various user configurable illumination modes for the relationship status bracelet in accordance with one exemplary embodiment of the present invention.

During operation, as represented in the block diagram illustrated in FIG. 4, the relationship status bracelet 100 may be placed into various light emitting modes, which in turn, visually communicate to other people the relationship status or other personal characteristic of the user. The relationship status bracelet 100 is placed into a first light-emitting mode by placing the magnet 300 in close proximity to the magnetic switch 260, as referenced in step 400, such that the magnetic field of magnet 300 operatively cycles the magnetic switch 260. The cycling of magnetic switch 260 provides a signal, which operatively engages with the electronic circuitry of electronic circuit assembly 200 (i.e., magnetic relay 230). The electronic circuit assembly 200 interprets the signal and advances the sequence of the system accordingly, such that power is provided to the light emitting diode 240 wherein the light emitting diode 240 emits a first light wave color such as green, in accordance with step 402. The green emitted light then signifies to others that the wearer of the relationship status bracelet 100 is single and receptive to being socially approached. Conversely, the wearer may desire to place the relationship status bracelet 100 into a second light-emitting mode, which signifies that the wearer is in a committed relationship and prefers against being socially approached. To place the relationship status bracelet 100 into the second light-emitting mode, the wearer temporarily positions the magnet 300 within a close proximity of the magnetic switch 260 a second time, as referenced in step 410. This causes the electronic circuitry of electronic circuit assembly 200 to sequence to the next status wherein the light emitting diode 240 emits a second light wave color such as red, as directed in step 412. The described embodiment utilizes multi-color emitting diodes. It is understood that the relationship status bracelet 100 may include a plurality of single color light emitting diodes, wherein the different diodes emit dissimilar colors to obtain the same desired end result. It is contemplated that each cycle of temporarily positioning the magnet 300 proximate to the magnetic switch 260 increments the light-emitting mode in a serial process and terminates at a deactivation step 420 by which the relationship status bracelet 100 is deactivated and no longer emits any light therefrom as referenced in step 422.

It is contemplated that several light emitting modes may be employed with the present invention by using various combinations of light emitting diodes, fiber optic strands or combinations thereof. Although the exemplary embodiment described above used a first and second light-emitting mode, it is envisioned that "$n^{th}$ modes" may be programmed and configured into the electronic circuitry of the present invention. Further, it is contemplated that other personal characteristics may be visually transmitted by other emitted colors. An exemplary chart of light emitting modes is presented in Table 1.

TABLE 1

Exemplary Emitting Color Modes and Translations

| Emitted Color | Keyword | Description |
|---|---|---|
| Green | Available | The wearer is available to date and is not currently dating anyone. |
| Red | Not Available | The wearer is not interested in meeting people to date and is in a committed relationship. Not interested in being pursued/approached. |
| Blue (Royal) | Long-Term (Family Orientated) | The wearer is looking for a meaningful relationship (i.e., soul mate). |
| Orange | Sensual | The wearer is interested in casual dating, fun/intimate encounters. |
| Purple | Spiritual | The wearer is a religious person, expresses spiritual beliefs etc. |
| Orange (dark) | Radical | The wearer is extreme and lives on the edge. |
| Blue (light) | Liberal | The wearer is a liberal person and has progressive views. |
| Pink | Conservative | The wearer is a conservative person and has conventional views. |
| White | Traditional (old fashioned) | The wearer has traditional values/morals/views. |
| Yellow | Drug Free | The wearer does not take our use drugs. |

In another exemplary embodiment, multiple light emitting diodes may be employed and independently selected to combine the various colors and thereby enhance the amount of information visually communicated. For example, one light emitting diode may selected to emit green light and another light emitting diode selected to emit royal blue light; thus the wearer would be available to meet new people and be looking for a long term relationship.

In another exemplary embodiment, the light emitting configuration can include a flashing light emitting function. The flashing light is provided to increase attraction to the relationship status bracelet 100. The electronic circuit assembly 200 can be configured to emit a steady or solid emission of light, a flashing light, or enable user selection between either configuration.

Although the above provides a full and complete disclosure of the preferred embodiments of the invention, various modifications, combinations, alternate constructions and equivalents will occur to those skilled in the art. It is intended that all matters in the foregoing description and shown in the accompanying drawings be interpreted as illustrative and not in a limiting sense. Therefore the above should not be construed as limiting the invention, which is defined by the appended claims and their legal equivalence.

What is claimed is:

1. A system for visually communicating a relationship status of a user to other persons, said system comprising:

a relationship bracelet configured for wearable deployment by a user, said relationship bracelet comprising a housing having a sidewall, a top surface, and an opposing bottom surface collectively defining a housing enclosure, a circumferential band extending from a first region of said housing to a second region of said housing, said second region being located circumferentially opposite said first region of said housing, and an electronic circuit assembly disposed within said housing enclosure, said electronic circuit assembly including a magnetically operated switch and a light emitting configuration in signal communication with said magnetically operated switch, said light emitting configuration having functionality for emitting light waves of at least first and second different colors, during at least corresponding first and second separate light-emitting modes, being visually recognizable by other people, said at least first and second different light wave colors correspondingly signifying at least first and second different relationship statuses of users; and a magnet movable repeatedly by a user to within and away from close proximity of said magnetically operated switch to thereby repeatedly cycle said magnetically operated switch to repeatedly provide a signal that causes said electronic circuit assembly to serially advance through, and activate each of, a sequence of modes, illuminated on said relationship bracelet by said light emitting configuration, that includes at least said first and second light-emitting modes and also a no-light-emitting mode respectively signifying said first relationship status of the user, said second relationship status of the user, and a deactivated status of said bracelet;

wherein a given one of said respective modes of said sequence once activated persists until terminated by said electronic circuit assembly serially advancing to, and activating, the next one of said respective modes of said sequence in response to a repetition of the movement of said magnet by the user to within and away from said close proximity of said magnetically operated switch.

2. The system as recited in claim 1, further comprising a fiber optic strand circumscribing said circumferential band, said fiber optic strand having at least one fiber optic end, said light emitting configuration being assembled in lighted communication with said at least one fiber optic end.

3. The system as recited in claim 1, wherein said light waves of said at least first and second different colors emitted during said corresponding at least first and second light-emitting modes provide illumination that is steady.

4. The system as recited in claim 1, wherein said light waves of said at least first and second different colors emitted during said corresponding at least first and second light-emitting modes provide illumination that is flashing.

5. The system as recited in claim 1, wherein said top surface of said housing is a translucent top cover, said translucent top cover being fabricated of a material enabling passage of light therethrough.

6. The system as recited in claim 1, wherein said bracelet further comprises a solar cell providing power to said electronic circuit assembly.

7. The system as recited in claim 1, wherein said bracelet further comprises a portable power storage device providing power to said electronic circuit assembly.

8. A system for visually communicating a relationship status of a user to other persons, said system comprising:

a relationship bracelet configured for wearable deployment by a user, said relationship bracelet comprising a housing having a sidewall, a top surface, and an opposing bottom surface collectively defining a housing enclosure, a circumferential band extending from a first region of said housing to a second region of said housing, said second region being located circumferentially opposite said first region of said housing, said circumferential band having a recess formed in a portion of said circumferential band at a location thereon being spaced opposite from said housing, said circumferential band being configured to undergo elastic deformation so as to allow said portion of said circumferential band and thereby said recess formed therein to be placed temporarily in close proximity to said housing, and an electronic circuit assembly disposed within said housing enclosure, said electronic circuit assembly including a magnetically operated switch and a light emitting configuration in signal communication with said magnetically operated switch, said light emitting configuration having functionality for emitting light waves of at least first and second different colors, during at least corresponding first and second separate light-emitting modes, being visually recognizable by other people, said at least first and second different light wave colors correspondingly signifying at least first and second different relationship statuses of users; and a magnet contained in said recess of said circumferential band and being movable repeatedly by a user to within and away from close proximity of said magnetically operated switch, by the user causing said circumferential band to undergo and then release from elastic deformation so as to temporarily place said portion of said circumferential band and said magnet contained in said recess formed in said portion in close proximity to said magnetically operated switch in said housing of said relationship bracelet, to thereby repeatedly cycle said magnetically operated switch to repeatedly provide a signal that causes said electronic circuit assembly to serially advance through, and activate each of, a sequence of modes, illuminated on said relationship bracelet by said light emitting configuration, that includes at least said first and second light-emitting modes and also a no-light-emitting mode respectively signifying said first relationship status of the user, said second relationship status of the user, and a deactivated status of said bracelet;

wherein a given one of said respective modes of said sequence once activated persists until terminated by said electronic circuit assembly serially advancing to, and activating, the next one of said respective modes of said sequence in response to a repetition of the movement of said magnet by the user to within and away from said close proximity of said magnetically operated switch.

9. The system as recited in claim 8, further comprising a fiber optic strand circumscribing said circumferential band, said fiber optic strand having at least one fiber optic end, said light emitting configuration being assembled in lighted communication with said at least one fiber optic end.

10. The system as recited in claim 8, wherein said light waves of said at least first and second different colors emitted during said corresponding at least first and second light-emitting modes provide illumination that is steady.

11. The system as recited in claim 8, wherein said light waves of said at least first and second different colors emitted during said corresponding at least first and second light-emitting modes provide illumination that is flashing.

12. The system as recited in claim 8, wherein said top surface of said housing is a translucent top cover, said translucent top cover being fabricated of a material enabling passage of light therethrough.

13. The system as recited in claim 8, wherein said bracelet further comprises a solar cell providing power to said electronic circuit assembly.

14. The system as recited in claim 8, wherein said bracelet further comprises a portable power storage device providing power to said electronic circuit assembly.

15. A method of identifying a relationship status, the method comprising steps of:

placing a relationship bracelet onto a wrist of an individual, said relationship bracelet comprising a housing having a circumferential sidewall, a top surface, and an opposing bottom surface collectively defining an enclosure, a circumferential band extending from a first region of said housing to a second, circumferentially opposite region of said housing, and an electronic circuit assembly disposed within said housing, said electronic circuit assembly including a magnetically operated switch and a light emitting configuration in signal communication with said magnetically operated switch, said light emitting configuration having functionality for emitting light waves of at least first and second different colors, during at least corresponding first and second separate light-emitting modes, being visually recognizable by other people, said first light wave color being illuminated during said first light-emitting mode signifying that said individual wearing said relationship bracelet is currently available and said second light wave color being illuminated during said second light-emitting mode signifying that said individual wearing said relationship bracelet is currently in a relationship;

moving a magnet to within and away from close proximity to said magnetically operated switch to thereby cycle said magnetically operated switch to provide a signal that causes said electronic circuit assembly to serially advance through, and activate each of, a sequence of modes, illuminated on said relationship bracelet by said light emitting configuration, that includes at least said first and second light-emitting modes and also a no-light-emitting mode wherein a given one of said respective modes of said sequence once activated persists until terminated by said electronic circuit assembly serially advancing to, and activating, the next one of said respective modes of said sequence in response to a repetition of the movement of said magnet to within and away from said close proximity of said magnetically operated switch; and terminating said moving of said magnet when said light emitting configuration of said electronic circuit assembly is operating in correspondence to the desired mode of said sequence of modes.

16. The method of identifying a relationship status as recited in claim 15, the method further comprising steps accomplished by a second individual, the steps comprising:

viewing the color of a currently emitted light wave; and determining the relationship status of said individual wearing said relationship bracelet by correctly interpreting the meaning of said color of said currently emitted light wave.

17. The method of identifying a relationship status as recited in claim 15, wherein said magnet is moved by causing said circumferential band to undergo and then release from elastic deformation so as to temporarily place a portion of said circumferential band containing said magnet in a recess in said portion in close proximity to said magnetically operated switch in said housing of said relationship bracelet.

18. The method of identifying a relationship status as recited in claim 15, said relationship bracelet further comprising a fiber optic strand visibly extending about said circumferential band, said fiber optic strand being in light communication with said light emitting configuration, the method further comprising a step of:

emitting light waves from circumferential band by transferring light from said light emitting configuration to said illuminating said fiber optic strand.

19. The method of identifying a relationship status as recited in claim 15, the method further comprising a step of:

cycling through said light emitting configuration, wherein said light emitting configuration comprises a series of unique colors, wherein said light emitting configuration comprise one unique color representing at least one of:

a) available for a relationship, b) seeking a casual relationship, c) seeking a long term relationship, d) unavailable for a relationship, e) has religious beliefs, f) has radical tendencies, g) has a liberal philosophy, h) has a conservative philosophy, i) has traditional values, and j) does not take drugs.

* * * * *